US011142903B1

(12) United States Patent
Jones, Jr. et al.

(10) Patent No.: US 11,142,903 B1
(45) Date of Patent: Oct. 12, 2021

(54) PROTECTIVE ENCLOSURE FOR INTERIOR AND EXTERIOR SPACES

(71) Applicant: NetTalon Security Systems, Inc., Fredericksburg, VA (US)

(72) Inventors: Donald R. Jones, Jr., New Canton, VA (US); Len R. Christensen, Florence, OR (US)

(73) Assignee: NETTALON SECURITY SYSTEMS, INC., Fredericksburg, VA (US)

( * ) Notice: Subject to any disclaimer, the term of this patent is extended or adjusted under 35 U.S.C. 154(b) by 0 days.

(21) Appl. No.: 17/160,051

(22) Filed: Jan. 27, 2021

Related U.S. Application Data

(60) Provisional application No. 63/039,450, filed on Jun. 15, 2020.

(51) Int. Cl.
*E04B 1/344* (2006.01)
*E04H 9/14* (2006.01)
*E04H 9/06* (2006.01)

(52) U.S. Cl.
CPC ..... *E04B 1/3445* (2013.01); *E04H 9/06* (2013.01); *E04H 9/14* (2013.01)

(58) Field of Classification Search
CPC .... E04B 1/34357; E04B 1/3445; E04B 1/344; E04B 1/3442; E04H 9/04; E04H 9/06; E04H 9/10; E04H 9/14; F41H 5/14; F41H 5/24
See application file for complete search history.

(56) References Cited

U.S. PATENT DOCUMENTS 3,984,949 A * 10/1976 Wahlquist ..... E04B 1/3445 52/70
6,874,284 B1 * 4/2005 Hayward ..... E04H 1/1261 52/220.2
7,934,444 B2 * 5/2011 Carberry ..... F41H 5/24 89/36.02
2003/0051825 A1 * 3/2003 Toepel ..... G21F 3/04 160/135
2007/0012168 A1 * 1/2007 Weatherwax ..... F41H 5/06 89/36.04
2009/0090475 A1 * 4/2009 Raniere ..... E04B 2/7431 160/351
2010/0192493 A1 * 8/2010 Nakai ..... E04B 2/7448 52/239

(Continued)

*Primary Examiner* — Christine T Cajilig
(74) *Attorney, Agent, or Firm* — Scott E. Gilbert

(57) ABSTRACT

Disclosed herein is a protective enclosure deployable within an interior space such as a school classroom or an office, or an exterior space. The deployable protective enclosure is to protect multiple occupants against projectiles such as flying or falling debris resulting from a natural disaster such as a tornado, hurricane or earthquake, or rounds fired. Occupants may be corralled into the protective enclosure and be protected against projectiles. The protective enclosure comprises three or more articulated partitions comprising ballistic materials or high-impact resistant materials. The protective enclosure may be affixed to one wall or two walls at a corner of a classroom, office or other space. The articulated partitions may be readily and rapidly secured in a protective configuration, forming a triangular, square or other polygonal enclosure. When not in use, the partitions may be folded and stowed against the walls.

20 Claims, 16 Drawing Sheets

(56) References Cited

U.S. PATENT DOCUMENTS

| | | | | |
|---|---|---|---|---|
| 2014/0174284 | A1* | 6/2014 | Peters | F41H 1/00 89/36.02 |
| 2015/0315776 | A1* | 11/2015 | Duncan | A01K 3/00 52/66 |
| 2019/0353465 | A1* | 11/2019 | Muth | F41H 5/24 |
| 2020/0248990 | A1* | 8/2020 | Larson | F41H 5/04 |

* cited by examiner

PROTECTIVE ENCLOSURE FOR INTERIOR AND EXTERIOR SPACES

CROSS-REFERENCE TO PRIORITY APPLICATION

This U.S. Patent Applications claims the benefit of U.S. Provisional Application 63/039,450, filed on 15 Jun. 2020.

BACKGROUND

In the event of a natural disaster such as a tornado, hurricane or earthquake, falling and flying debris may injure occupants sequestered or trapped within a classroom, multipurpose room, a room of a domicile, an office or in an outdoor environment. Similarly, when an active shooter threat looms, the fact is that in most building structures today, the interior rooms are all defined by soft walls. This includes wall board or drywall, which are easily penetrated by all small arms fire and other projectiles, putting victims sheltering in those rooms at life risk.

DETAILED DESCRIPTION

Figure 1A:
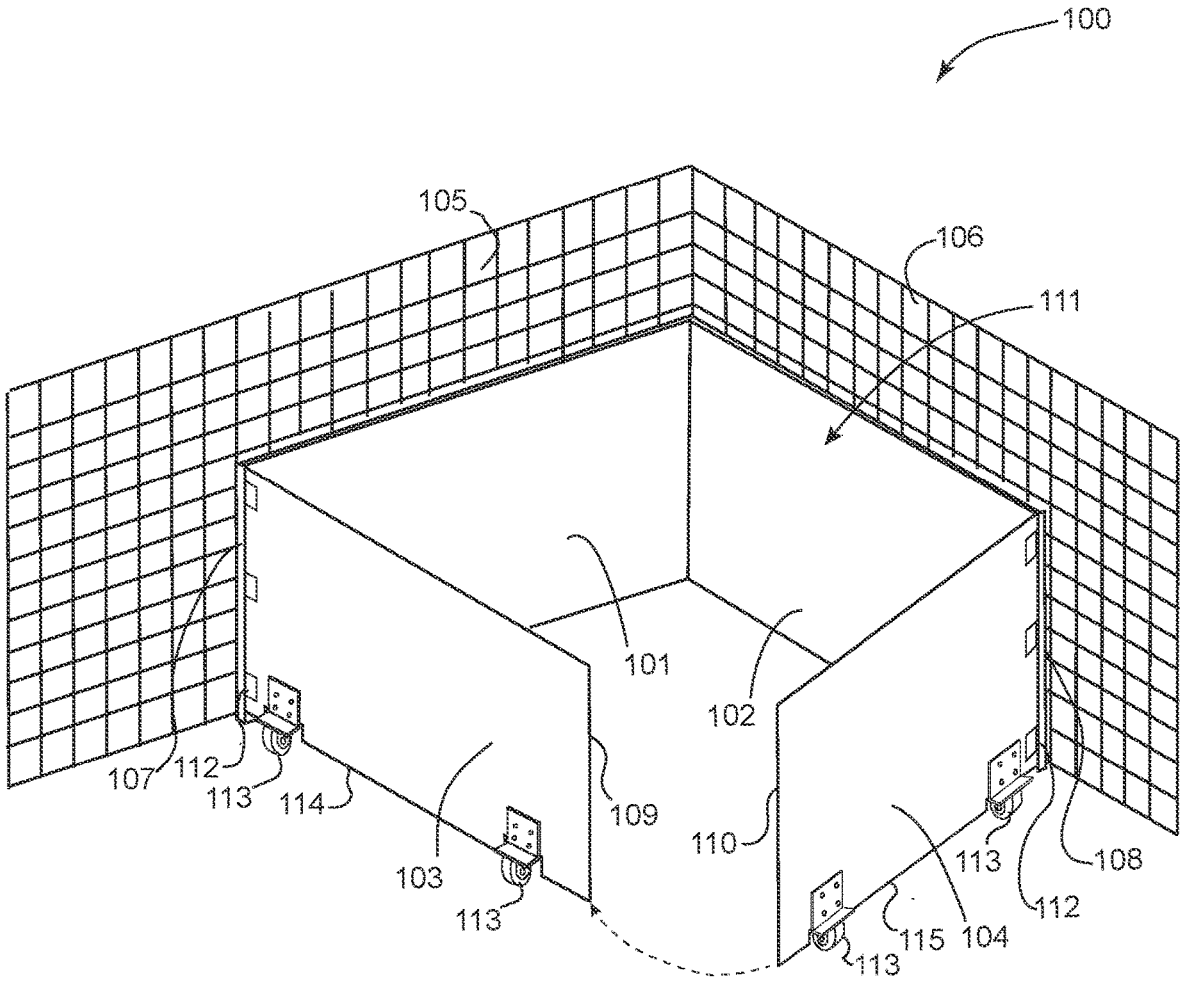
FIG. 1*a*. Perspective view of an embodiment of a four-sided protective enclosure in a partially deployed configuration and affixed to interior or exterior walls at a corner, according to some embodiments of the disclosure.

Disclosed herein is a deployable protective enclosure for shielding persons occupying an interior or exterior space from falling or flying projectiles and debris caused by a natural disaster such as a tornado, hurricane or an earthquake. The disclosed protective enclosure may further be deployed to shield occupants from bullets fired in an active shooter event. The disclosed protective enclosure may be deployed within an interior space, for example, inside of an office, a multipurpose room or a classroom. Alternatively, the disclosure configurable protective enclosure may be deployed in an exterior environment, such as a playground, a parking lot, or yard.

In some embodiments, the disclosure protective enclosure is attached to at least one interior wall of a room or building, or along an exterior wall. In some embodiments, the protective enclosure is affixed to two intersecting walls, for example at a corner of a room. In other embodiments, the disclosure protective enclosure is a free-standing structure that may be deployed independently of any interior or exterior walls and positioned freely within a room. According to some embodiments, the deployable protective enclosure comprises three or four fixed and articulated partitions, coupled to each other by hinges. For example, the deployable protective enclosure may comprise at least one partition affixed to a permanent wall (e.g., a wall of a room), to which two articulated partitions are attached by hinges on opposing sides of the stationary partition. A fourth articulated partition may be attached to a free edge of one of the partitions that pivot relative to the stationary partition.

The articulated partitions may each be equipped with at least one heavy duty caster allowing them to be quickly moved into position, forming a protective enclosure that provides 360-degree protection by abutting together the free vertical edges of the articulated and fixed partitions. In some embodiments, handles may be included on the articulated partitions to facilitate handling and manipulating the articulated partitions. In other embodiments, means are included for securing the articulated partitions when the protective enclosure is deployed. The latter action may form substantially triangular, rectangular, rhombic or pentagonal protective enclosures, described herein, providing a safe space for victims in the room to shelter. The innovative protective enclosure is by no means limited to these shapes. Any polygonal shape may be conceived, hexagonal and higher polygonal configurations.

In some embodiments, the deployable protective enclosure comprises two partitions that are affixed to two intersecting permanent walls (e.g., at a corner or a room) and are thus stationary. In some embodiments, a single articulated partition is hinged to one of the two stationary partitions, whereby the free edge of the single articulated partition may be secured to a free edge of one of the two stationary partitions. A protective enclosure having a triangular configuration may be thus formed.

In some embodiments, two articulated partitions are hinged to both of the two stationary partitions that are affixed to two intersecting walls at a corner of a room, whereby the free edges of the two articulated partitions may be secured to each other. A protective enclosure having a quadrangle (e.g., square, rectangle or rhombic) configuration may be thus formed.

In some embodiments, at least one of the partitions of the configurable protective enclosure comprise materials capable of deflecting high-velocity projectiles, such as bullets fired from a high-powered weapon. As an example, the material may be a high-strength, high ductility steel alloy, such as AR 500 steel plate. In some embodiments, suitable materials may comply with National Institute of Justice (NIJ) standards for ballistic materials, described below. Other high-strength, high-impact resistant materials may also be employed.

Wheels or rollers may be attached to the bottoms of the articulated partitions to facilitate deployment of the movable partitions into position when needed. When not deployed, articulated partitions may be stowed by folding against each other and/or the one or two stationary partitions.

In some embodiments, a deployable ceiling comprising high-strength cables attached to one or more of the partitions is provided. The cables may be extended over the top of the disclosed protective enclosure to form a grid, protecting occupants from falling debris. Falling debris may result from a tornado, hurricane or earthquake for example. Falling debris may also result from a man-made disaster, such as a bombing or a war. The deployable ceiling may comprise multiple cables, each cable having one or both ends attached along a top edge of two or more stationary or articulated partitions.

In some embodiments, the deployable ceiling may comprise three or more high-strength (e.g., having a break strength of 3,000 lbs to 10,000 lbs) steel cables that are permanently attached to at least one partition (e.g., stationary or articulated) at one end. The second ends of the three or more steel cables may be attachable to a one or more partitions facing the first partition.

In some embodiments, one or more of the partitions may comprise a hatch that is provided to permit entrance or exit from the disclosed protective enclosure when fully deployed, while maintaining closure of the articulated partitions.

In this disclosure, it is understood that the terms "over", "under", "above", "below", "upper", "lower", "top" and "bottom" have the usual structural meanings, referring to relative vertical positions within structural embodiments and to their immediate environment as viewed within the associated figures. Similarly, the terms "left", "right", "side" and "sideways" have the usual structural meanings, referring to relative horizontal positions within structural embodiments and within their immediate environment as viewed within the associated figures.

The terms "substantial" or "substantially" are used within this disclosure to mean "the greater part of", "mostly" or "mostly to fully". For example, "substantially" may qualitatively indicate a measure within 10% of a quantifiable attribute, with the possibility that the measure may range from 90% to 100% of the quantifiable attribute.

All views illustrating the described embodiments of the protective enclosure provided by the figures described by this disclosure are three-dimensional perspective views to show all or most features of the embodiments described within a single view.

FIG. 1*a* shows a perspective-view of protective enclosure 100, comprising partitions 101, 102 103 and 104. In some embodiments, partitions 101 and 102 are attached to intersecting walls 105 and 106. Walls 105 and 106 may be interior or exterior intersecting walls, for example at an interior corner of a room, as shown in the illustrated embodiment. Walls 105 and 106 may also be situated on the exterior or outside of a building. Partitions 101 and 102 may be immobile by being affixed to walls 105 and 106, whereby they are not free to move or pivot. In some embodiments, fixed partitions 101 and 102 is attached to walls 105 and 106 by suitable fasteners. Partitions 103 and 104 have an articulated joint with partitions 101 and 102, whereby each may respectively pivot at vertical edges 107 and 108 of fixed partitions 101 and 102, respectively, to open or close protective enclosure 100.

In the illustrated embodiment, protective enclosure 100 is shown in a partially closed configuration, whereby partition 103 articulates from vertical edge 107 of fixed partition 101 and is substantially parallel to fixed partition 102 in a deployed state. Partition 104 articulates from vertical edge 108 of fixed partition 101 and is shown to be in a semi-deployed state, whereby vertical edge 109 of partition 103 not adjacent to nor joined with vertical edge 110 of partition 104. Protective enclosure 100 may be closed when vertical edges 109 and 110 are substantially adjacent to one another, as indicated by the dashed arrow, forming a closed polygon (e.g., a four-sided structure such as a square, rectangle, rhombus or other parallelogram) surrounding interior space 111. A latching or locking mechanism (described below) may be present to secure partitions 103 and 104 in place.

Figure 6A:
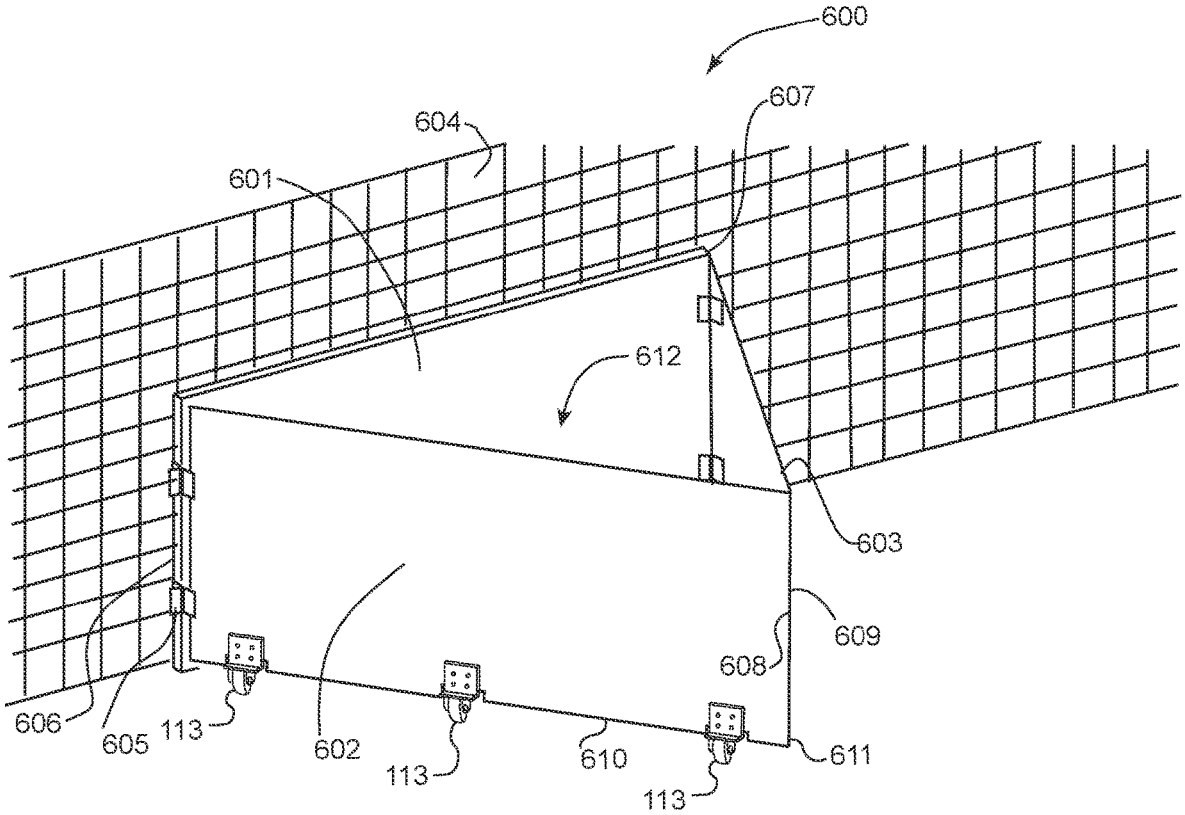
FIG. 6*a*. Perspective view of a second alternative embodiment of a three-sided protective enclosure affixed to a single interior or exterior wall, according to some embodiments of the disclosure.
Figure 6B:
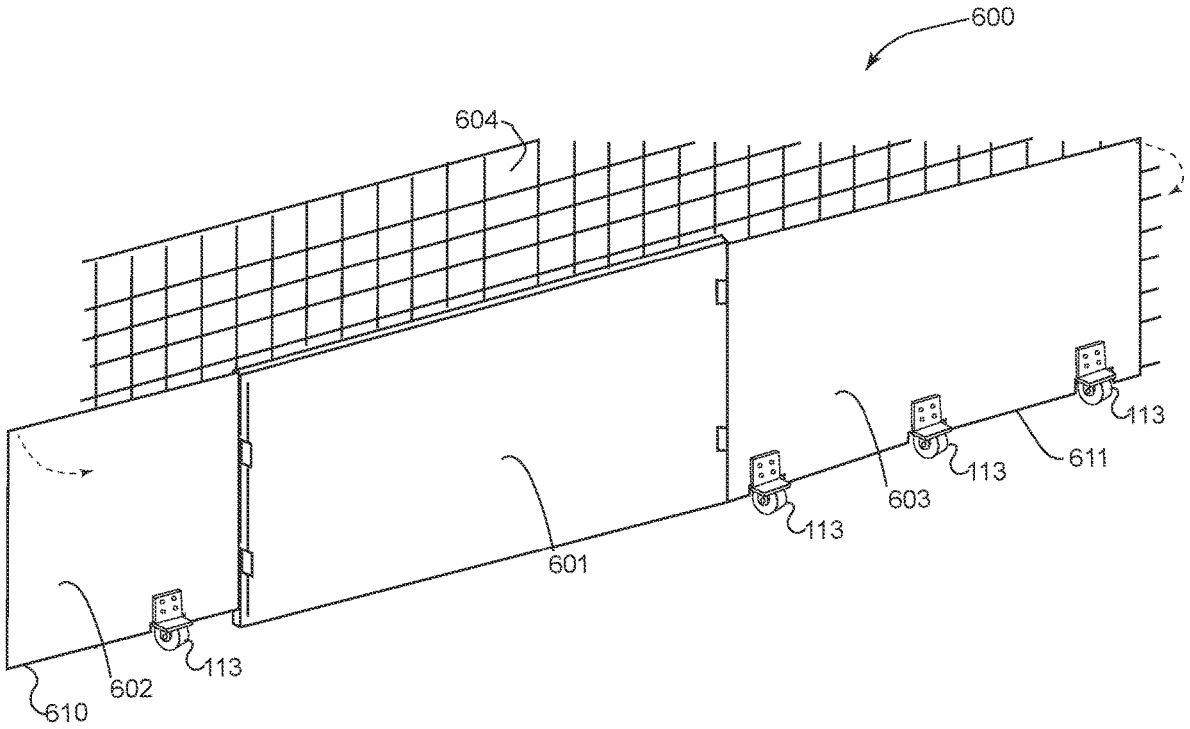
FIG. 6*b*. Perspective view of the three-sided protective enclosure shown in FIG. 6*a* in a stowed configuration, according to some embodiments of the disclosure.

In some embodiments, articulating partitions 105 and 106 are joined to fixed partitions 101 and 102 by hinges 112. In some embodiments, articulating partitions 103 and 104 may each be supported by one or more casters 113 along bottom horizontal edges 114 and 115 or articulated partitions 103 and 104, respectively. Casters 113 may facilitate movement of articulated partitions 103 and 104 for positioning them into a closed (e.g. for protective deployment) or an open configuration (e.g., for stowage). Casters 113, details of which are described below, may be wheels, as shown in the illustrated embodiment, or ball rollers. While two casters are shown for each of articulated partitions 103 and 104, any suitable number of casters may be employed. For example, three casters distributed along a bottom horizontal edge of articulated partitions are shown in FIGS. 6*a* and 6*b*.

In a protective deployment, occupants may gather within interior space 111 and be protected from lateral projectiles within a room (e.g., within walls 105 and 106) by partitions 103 and 104. Fixed partitions 101 and 102 may protect occupants from any laterally flying or ballistic projectiles (e.g., bullets) that may penetrate through walls 105 and 106.

In some embodiments, partitions 101-104 each comprising materials, such as, but by no means limited to, bullet-proof (e.g., "ballistic") materials capable of deflecting high-speed projectiles such as bullets fired by high-powered weapons. In some embodiments, materials included within this disclosure may comply with ballistic ratings by the National Institute of Justice (NIJ). For example, suitable materials may comply with any of NIJ Level IIa, Level II, Level Ma, Level III, Level IV ballistic material ratings for impact resistance. NIJ levels describe a material's ability to stop a specified round at a specified velocity, whereby Level IV has the highest rating.

In some embodiments, one or more of partitions 101-104 are compliant with any of NIJ ratings between Level IIa, Level II, Level Ma, Level III, Level IV. As an example, one or more of partitions 101-104 may comprise AR 500 alloy steel plate, having a NIJ Level III or NIJ Level IV rating. The AR500 steel plate may have a thickness between 0.25 inches and 1 inch, corresponding to NIJ Level III or IV ballistic impact standards. In other embodiments, one or more of partitions 101-104 may comprise but are not limited to NIJ Level IIa or greater ballistic fiberglass composite, NIJ level IIa or greater ballistic silicon carbide plate, NIJ level IIa or greater ultra-high molecular weight polyethylene (UHMWPE) (e.g., Dyneema) plate, Kevlar and similar materials, and NIJ level IIa or greater ballistic ceramic/polyethylene composite. Other suitable high-strength or high-impact materials may be employed.

Partitions 101-104 may also have suitable height and length dimensions to meet capacity requirements. For example, protective enclosure 100 may be a four-walled enclosure as shown, dimensioned to accommodate 10-20 occupants. To adequately shelter 10 occupants, partitions 101-104 may have dimensions of 4 feet tall and 8 feet long, each having a thickness of 0.25 inch to 0.5 inch. The weight of articulated partitions 103 and 104 may be a factor determining the choice of partition thickness. For example, a 0.25 inch thick×48 inch×96 inch plate of AR100 steel (e.g., having a density of approximately 0.28 lbs/in$^3$), may weigh approximately 323 pounds (147 kg). Multiple casters 113 deployed on each articulated partition may support such weight, and readily facilitate the manipulation of articulated partitions 103 and 104 by children, for example.

Figure 1B:
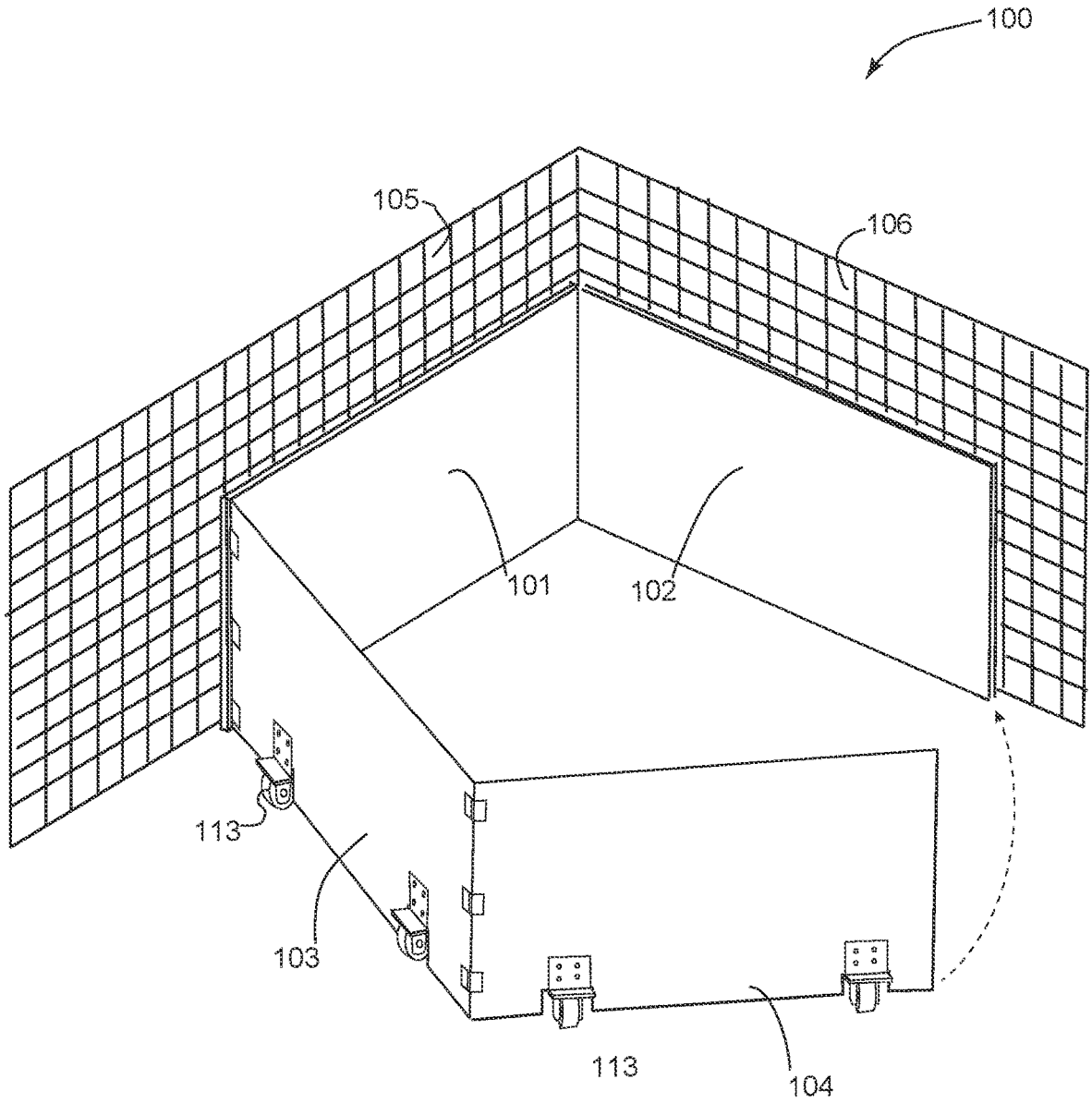
FIG. 1*b*. Perspective view of an alternative embodiment of the four-sided protective enclosure shown in FIG. 1*a* in a partially deployed configuration, according to some embodiments of the disclosure.

FIG. 1*b* shows an alternate embodiment of protective enclosure 100, where partition 104 has an articulated joint with partition 103 between vertical edges 109 and 110. Partition 103 has an articulated joint with fixed partition 101 as shown in FIG. 1*a*. During deployment, partition 104 may be pivoted into a desired position in succession with partition 103, where partition 103 may be pivoted into position first, followed by partition 104. Closure of protective enclosure 100 may be performed by pivoting articulated partition 103 into interior space 111, juxtaposing vertical edge 130 of articulated partition 104 adjacent to or against vertical edge 108 of fixed partition 102 (e.g., following the arc indicated by the dashed arrow).

Figure 1C:
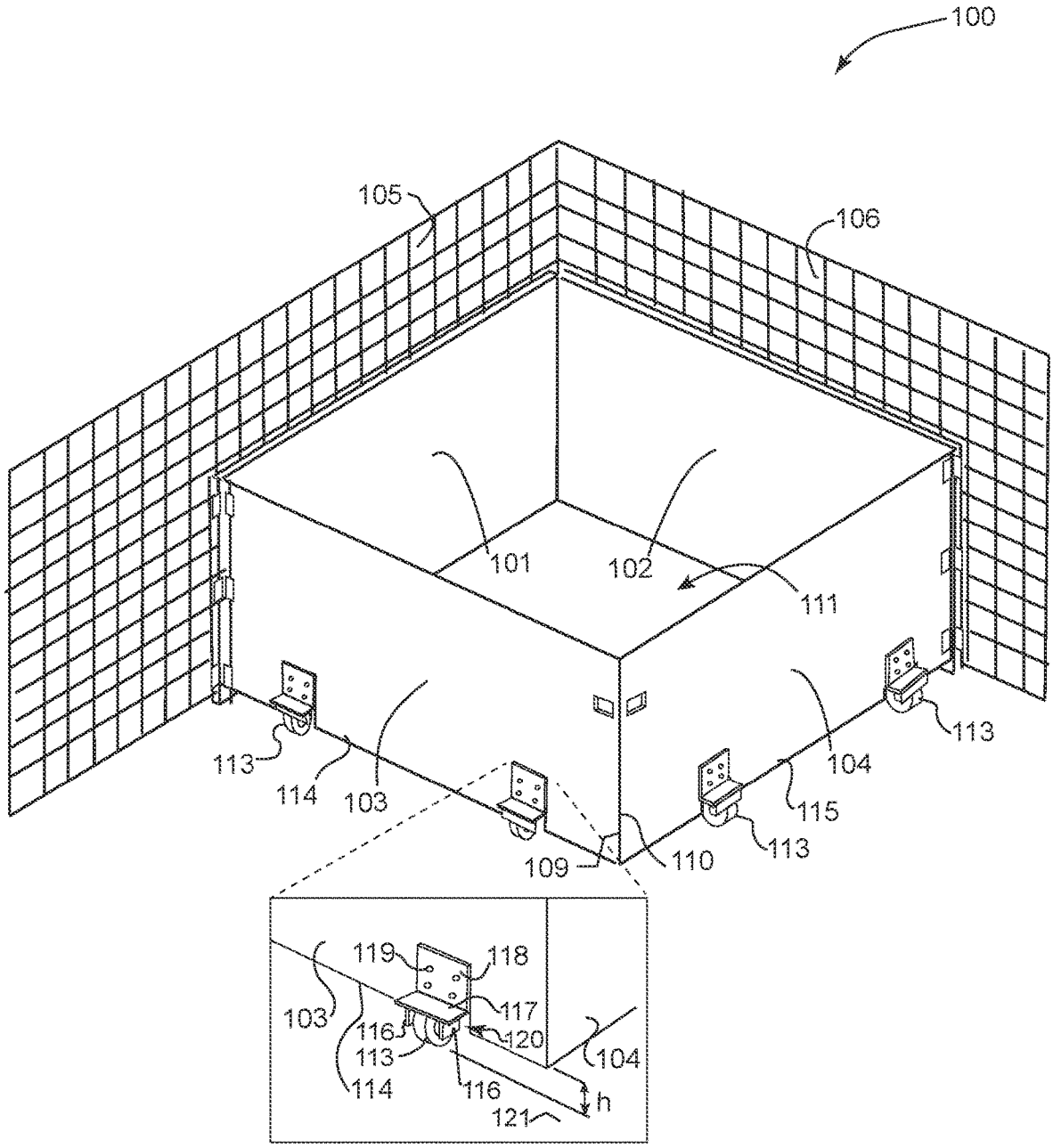
FIG. 1*c*. Perspective view of a fully deployed configuration of the four-sided protective enclosure shown in FIG. 1*a*, according to some embodiments of the disclosure.

In FIG. 1*c*, the embodiment of protective enclosure 100 shown in FIG. 1*a* is shown in perspective view in a fully-closed protective configuration. In the illustrated example, articulated partition 104 has been pivoted to join vertical edge 110 to vertical edge 109 of articulated partition 103. In some embodiments, a securing means, such as a latch or other suitable locking mechanism that is installed on the interior sides of articulated partitions 103 and 104 (not shown) at vertical edges 109 and 110 may employed to secure articulated partitions 103 and 104 in place. In some embodiments, articulated partitions 103 and 104 may be secured in place by a drop bolt or cane bolt, as employed for securing gates. In the closed configuration, partitions 104 may be substantially parallel to fixed partition 101, and substantially orthogonal to partitions 102 and 103. Likewise, partition 103 may be substantially orthogonal to partitions 101 and 104. In the fully deployed configuration, partitions 101-104 may form the perimeter of a four-sided polygon surrounding interior space 111, such as a square (as shown), rectangle or rhombus (e.g., a diamond shape).

Exemplary mounting details of caster 113 are illustrated in the inset of FIG. 1*c*. Caster 113 is shown as a wheel and may also be a ball roller as noted above. Caster 113 is affixed to struts 116, for example by an axle (not shown). Struts 116 may be welded to flange 117 that is integral with mounting plate 118. Mounting plate 118 may comprise hardened steel alloy such as AR500. Mounting plate 118 may be affixed to articulated partitions 103 and 104 with bolts 119 as shown. In some embodiments, notch 120 is recessed from a bottom edge 114 of partition 103 and 104. Caster 113 may be nestled within notch 113, providing a clearance h between bottom horizontal edge 114 and floor 121. Clearance h may range between 0.5 inches to several inches. For example, clearance h may be 2 inches.

As will be described below and shown in FIGS. 8*a*-8*c*, a deployable protective ceiling may optionally be included in the embodiments of protective enclosure 100 and further embodiments described below, whereby the deployable protective ceiling may comprise multiple high-strength steel cables deployed in a grid configuration.

Figure 1D:
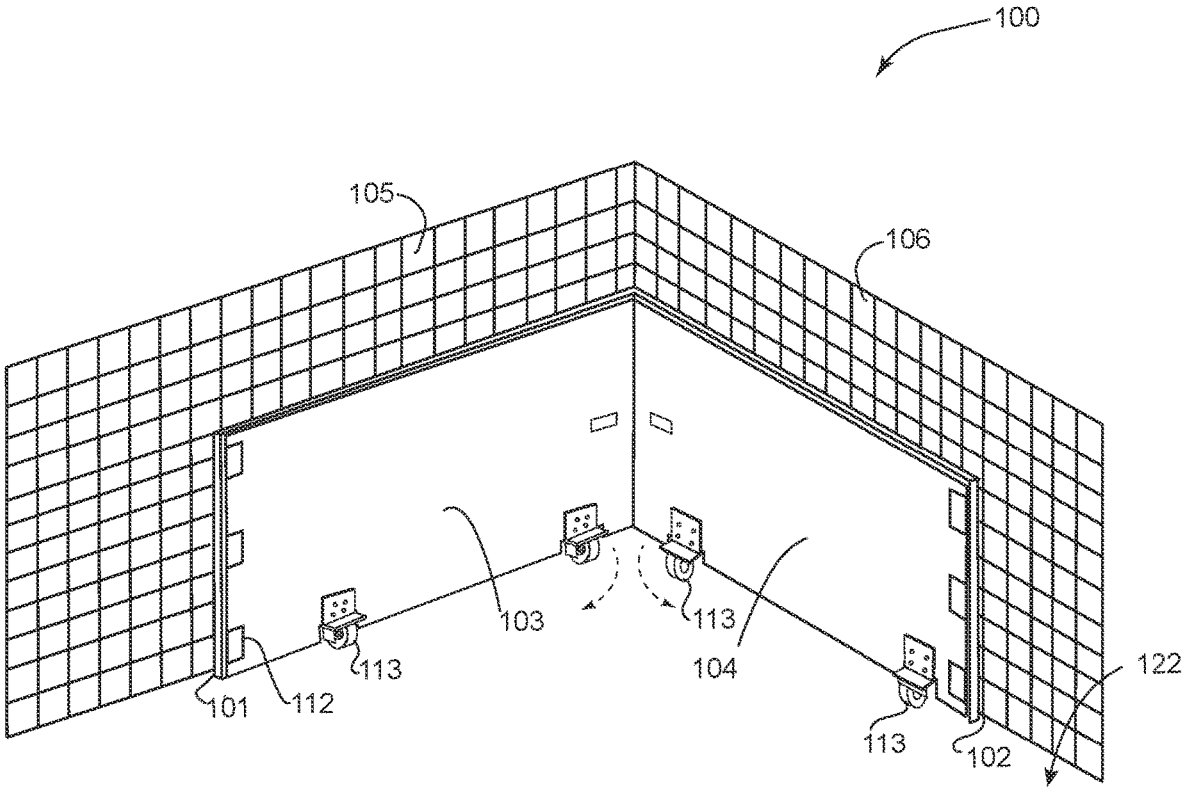
FIG. 1*d*. Perspective view of a stowed configuration of the protective enclosure shown in FIG. 1*a* or 1*c*, according to some embodiments of the disclosure.

In FIG. 1*d*, protective enclosure 100 is in a stowed position. Both articulated partitions 103 and 104 folded against fixed partitions 101 and 102 in a stowed position. In this configuration, protective enclosure 100 may not encumber the surrounding space within room 122, such as classroom or office. In some embodiments, articulated partitions 103 and 104 may be secured against the walls 105 and 106, to which partitions 101 and 102 are affixed. By way of example, eyebolts (described below) may be used.

Figure 2:
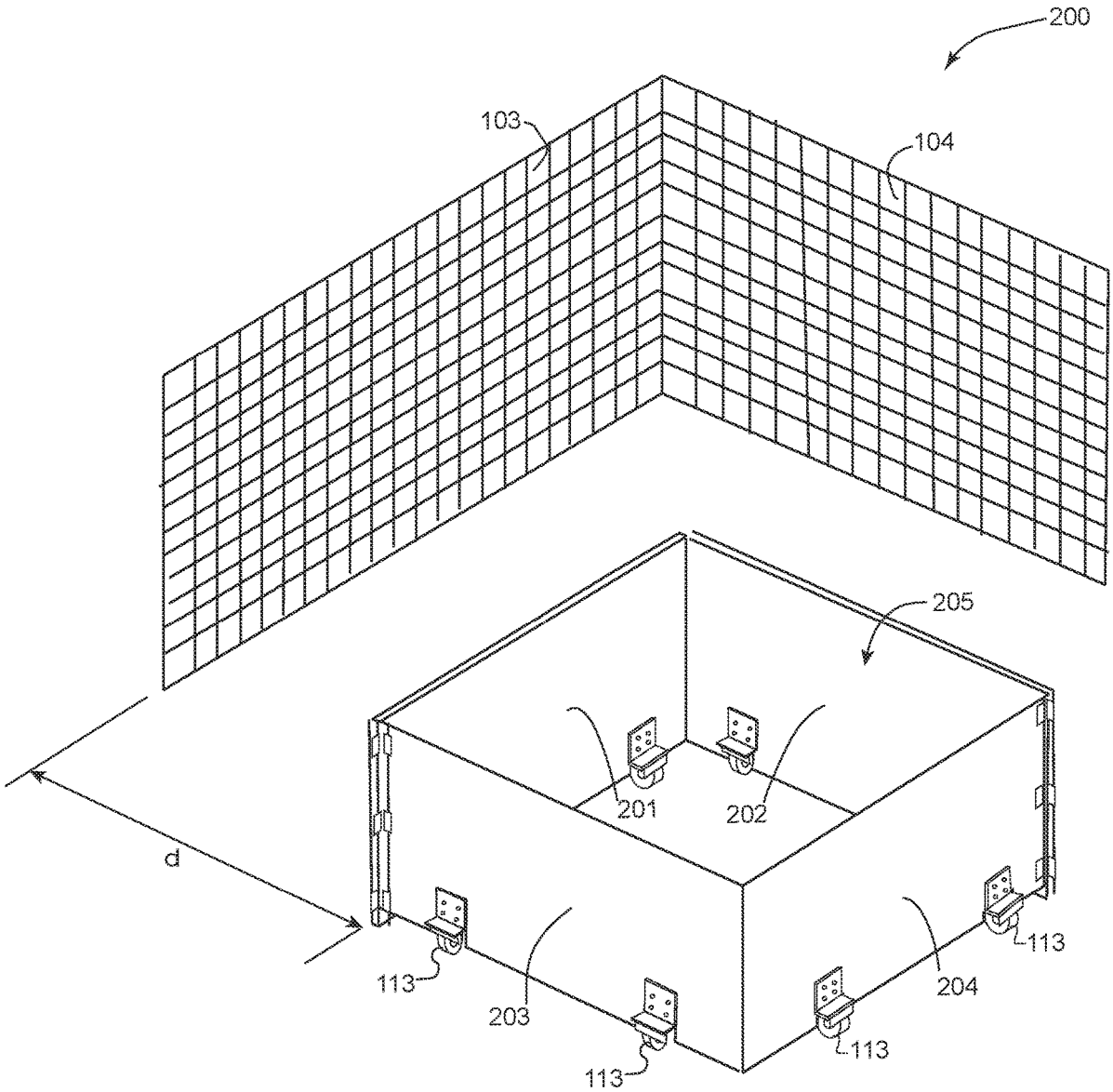
FIG. 2. Perspective view of a stand-alone embodiment of a four-sided protective enclosure where the protective enclosure is detached from interior or exterior walls, according to some embodiments of the disclosure.

In FIG. 2, the embodiment of protective enclosure 200 is a stand-alone enclosure comprising articulated partitions 201,202, 203 and 204. Protective enclosure 200 is shown detached from room walls 103 and 104 and spaced therefrom by a distance d, where each of partitions 201-204 comprise at least two casters 113 for facilitating mobility. Protective enclosure 200 may be positioned against room walls 103 and/or 104 if desired for enhanced protection.

Figure 3A:
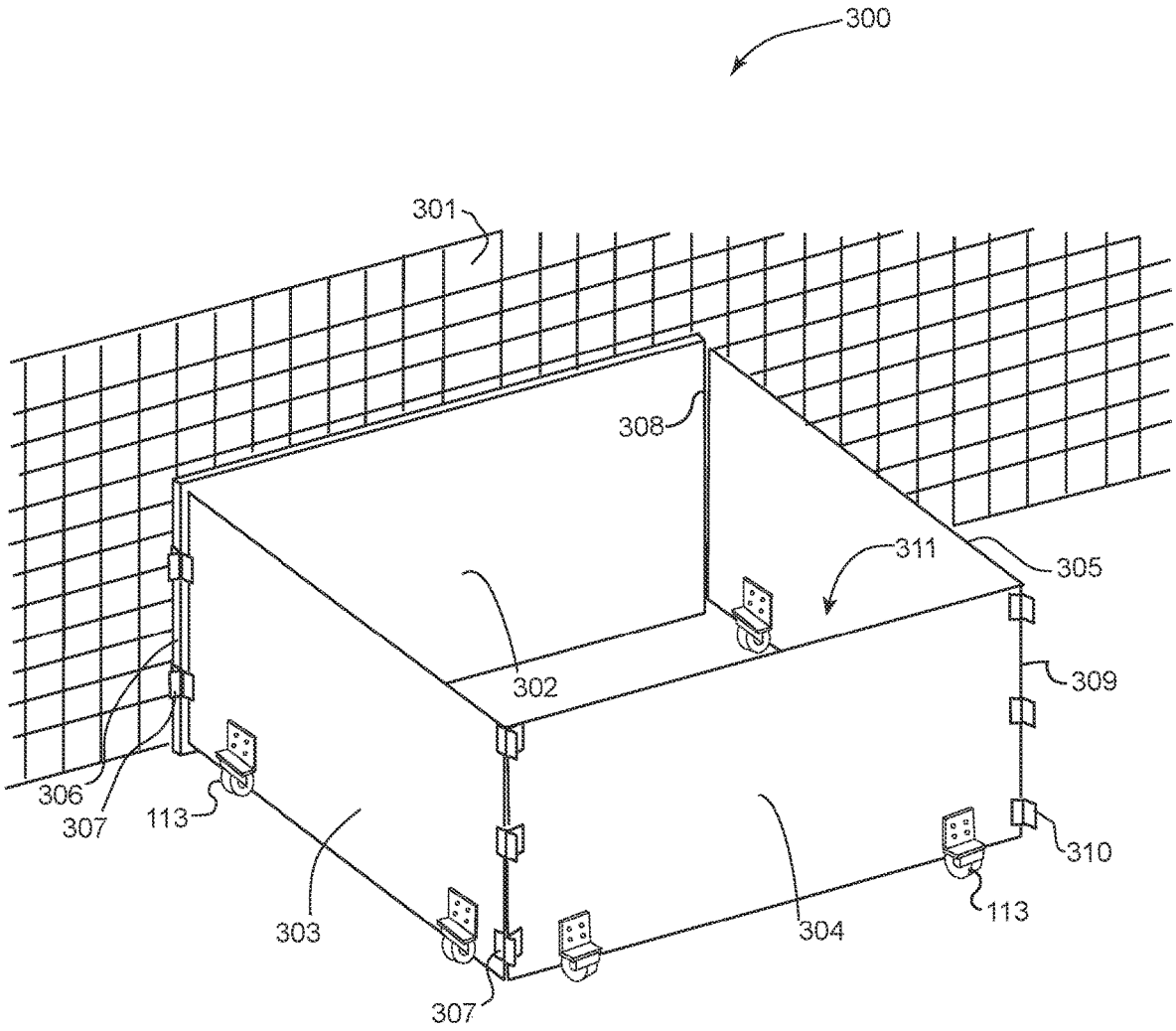
FIG. 3*a*. Perspective view of an embodiment of a four-sided protective enclosure in a fully deployed configuration affixed to a single interior or exterior wall, according to some embodiments of the disclosure.

FIG. 3*a* illustrates an alternative embodiment of protective enclosure 300 attached to a single wall 301. Protective enclosure 300 may be substantially at a mid-wall distance from a corner, according to some embodiments. In FIG. 3*a*, protective enclosure 300 is installed along wall 301, substantially away from a corner, according to some embodiments. In this mid-wall embodiment as illustrated in FIG. 3*a*, a single fixed partition 302 is affixed to wall 301

Protective enclosure 300 comprises fixed partition 302 affixed to room wall 301, and articulated partitions 303, 304, and 305 may be daisy-chained together from fixed partition 302, as shown in the illustrated embodiment, or have articulated partitions attached to opposing vertical edges of fixed partition 302. The three articulating partitions 303, 304 and 305 may articulate with each other in such a way that one articulated partition (e.g., partition 303) articulates with fixed partition 302. In the illustrated embodiment, protective enclosure 300 comprises a wrap-around configuration comprising partitions 302-305. As shown in FIG. 3*a*, articulated partition 303 is attached to one edge 306 (e.g., the left edge) of fixed partition 302 by hinges 307. Articulated partition 305 may articulate from edge 308 (e.g., left edge) of fixed partition 302 or pivot from edge 309 of articulated partition 304. In the illustrated embodiment, articulated partition 305 is attached to edge 309 of partition 304 by hinges 310.

Although not shown, it is understood that a means to secure partitions 303-305 in place may be employed, as described above.

In alternative embodiments, partition 305 may be attached to vertical edge 308 of fixed partition 302, followed by partition 304 attached to vertical edge 309 by hinges 310. Partition 304 may close against 303. A latching means may be employed to secure partition 304 to partition 303. Interior space 311 surrounded by partitions 302-305 may accommodate multiple occupants. Partitions 301-304 form the perimeter of a four-sided polygon, such as a square as shown. Other quadrangular shapes may be also assumed depending on the relative lengths of partitions 301-304, such as a rectangle, rhombus or other parallelogram.

Partitions 302-305 may comprise steel plates and other materials substantially as described above. For example, partitions 302-305 may have overall dimensions of 4 feet×8 feet. In some embodiments, AR500 steel plate having a thickness of 0.25 inch to 0.5 inch may be employed. For example, fixed partition 302 may comprise AR500 plate having a thickness of 0.5 inch, whereas mobile partitions 303-305 may comprise AR500 plate having a thickness of 0.25 to 0.375 inch. Other materials and dimensions may be employed by any or all of partitions 302-305.

Figure 3B:
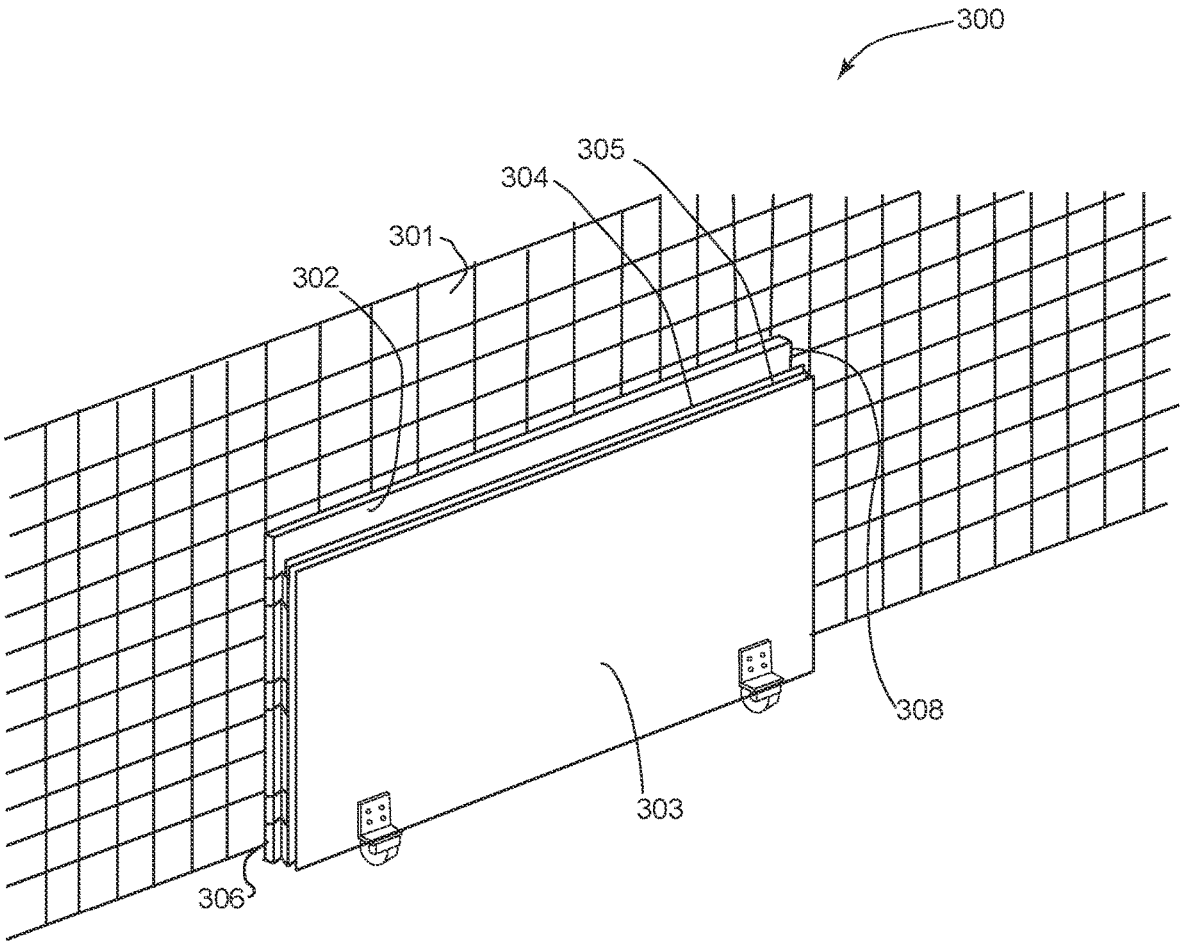
FIG. 3*b*. Perspective view of the four-sided protective enclosure shown in FIG. 3*a* in a stowed configuration, according to some embodiments of the disclosure.

FIG. 3*b* illustrates protective enclosure 300 in a stowed configuration. In the illustrated embodiment, articulated partitions 303-305 are folded together into a horizontal stack in a manner following the order of attachment, (e.g., articulated partition 305 folded against articulated partition 304, and against partition 303), and may be stacked against fixed partition 302. In an alternate embodiment described above, articulated partition 305 may pivot from the right vertical edge (e.g., vertical edge 308) of fixed partition 302, while partition 303 may pivot from the left edge (e.g., vertical edge 306) of fixed partition 302. Articulated partition 304 may be folded against partition 305 for stowage, and then pivoted against fixed partition 302. Articulated partition 303 may also be folded down over stowed partitions 304 and 305.

Figure 4A:
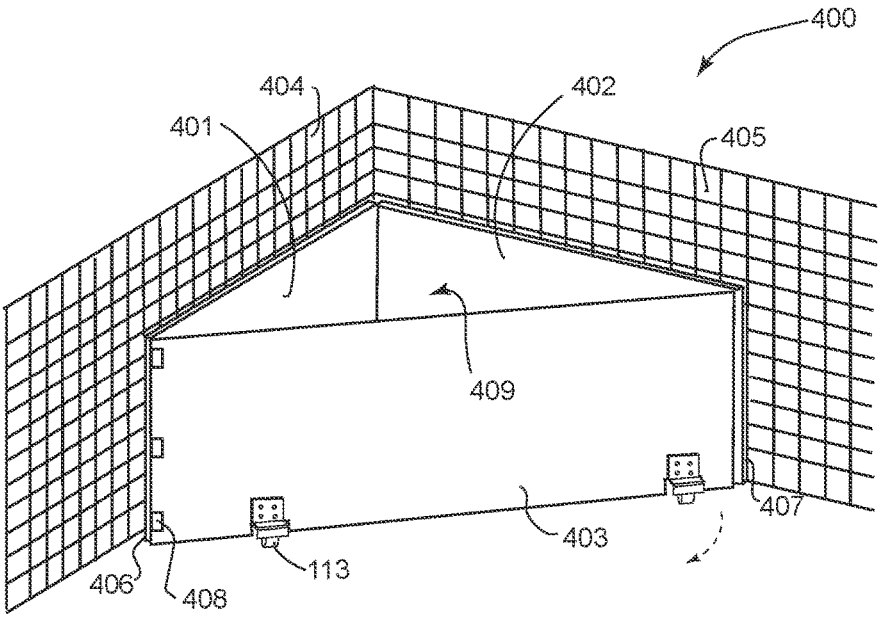
FIG. 4*a*. Perspective view of a three-sided protective enclosure in a fully deployed configuration, affixed to two interior or exterior walls at a corner, according to some embodiments of the disclosure.

FIG. 4*a* illustrates three-sided protective enclosure 400, comprising fixed partitions 401 and 402 and a single articulating partition 403. Fixed partitions 401 and 402 may be affixed to intersecting walls 404 and 405, for example at the corner of an office or classroom. Articulated partition 403 may articulate from vertical edge 406 of fixed partition 401 or from vertical edge 407 of fixed partition 402, however is shown to have an articulated joint with fixed partition 401 at vertical edge 407, having the ability to swing outward, as indicated by the dashed arrow in the figure. Hinges 408 may be employed to hang articulated partition 403 from fixed partition 401, whereas casters 113 may facilitate manipulation of articulated partition 403. It will be understood that although not shown, a means to secure articulated partition 403 in a closed position may be present, as described above. In the fully deployed state, partitions 401-403 form the perimeter of a triangular polygon.

Figure 4B:
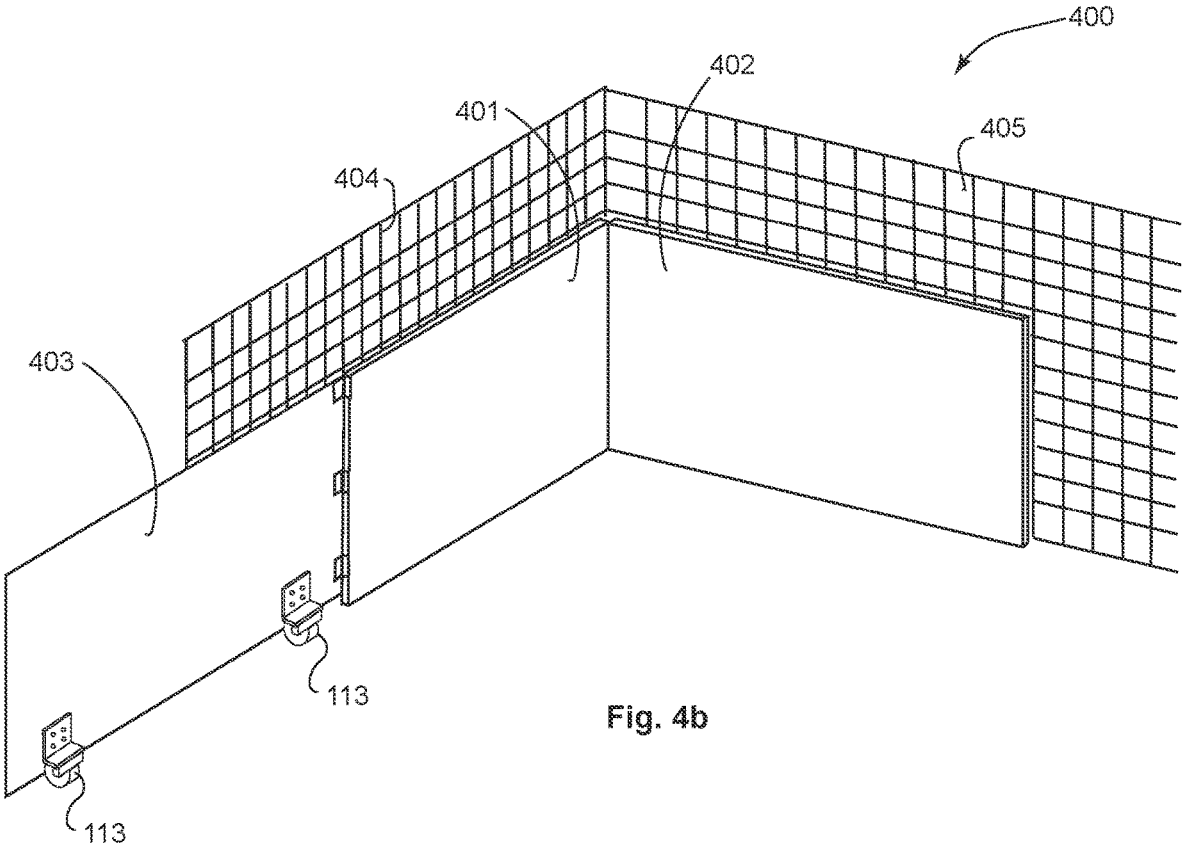
FIG. 4*b*. Perspective view of the three-sided protective enclosure embodiment shown in FIG. 4*a*, in a stowed configuration, according to some embodiments of the disclosure.
Figure 5A:
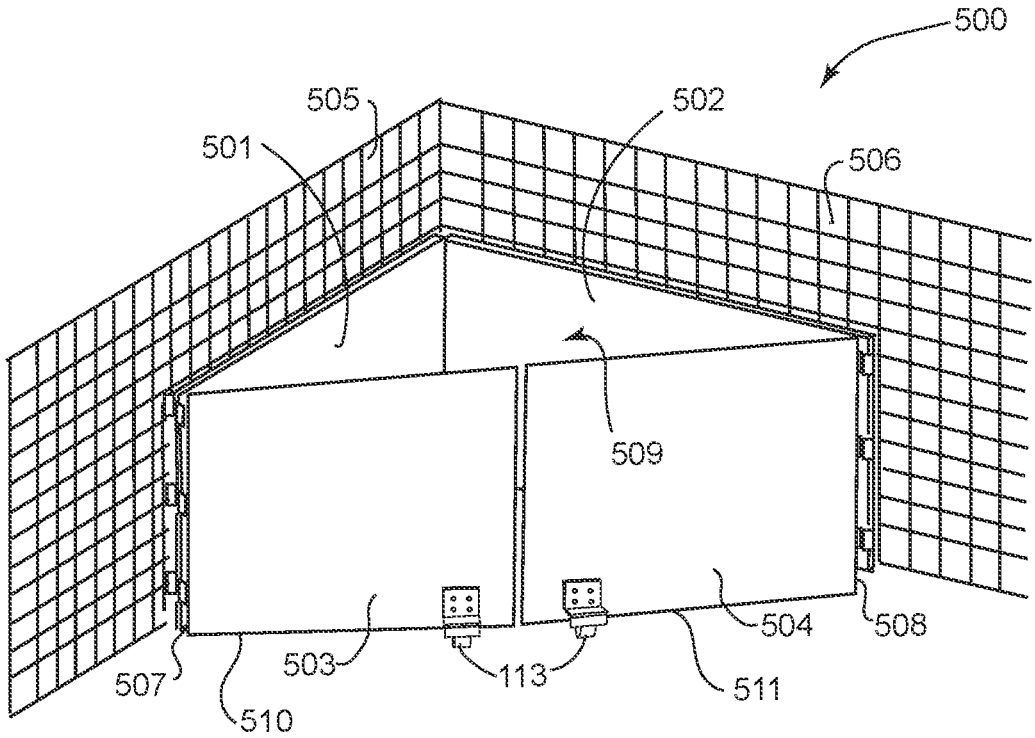
FIG. 5*a*. Perspective view of an alternative embodiment of a three-sided protective enclosure affixed to two interior or exterior walls at a corner, according to some embodiments of the disclosure.

FIG. 4*b* illustrates protective enclosure 400 in an exemplary stowed configuration. Articulated partition 403 may be swung to an open position, being against wall 404, for example. Alternatively, partitions 405 and 406 may be opened to stack against room walls 403 and 404 (not shown) when stowed FIG. 5*a* shows alternative triangular protective enclosure 500. While a three-sided enclosure, protective enclosure 500 comprises fixed partitions 501 and 502 and two articulated partitions 503 and 504. Fixed partitions are affixed to intersecting walls 505 and 506. Walls 505 and 506 may be at a corner of a room, for example. Articulated partitions 503 and 504 may each have a horizontal dimension that is approximately half the distance from edge 507 of fixed partition 501 to edge 508 of fixed partition 502. When in a closed position, as shown, articulated partitions 503 and 504 may jointly span the distance between edges 507 and 508, enclosing interior space 509 by three sides. As noted above, partitions 501-503 may form the perimeter of a triangular polygon when protective enclosure 500 is fully deployed.

Figure 9:
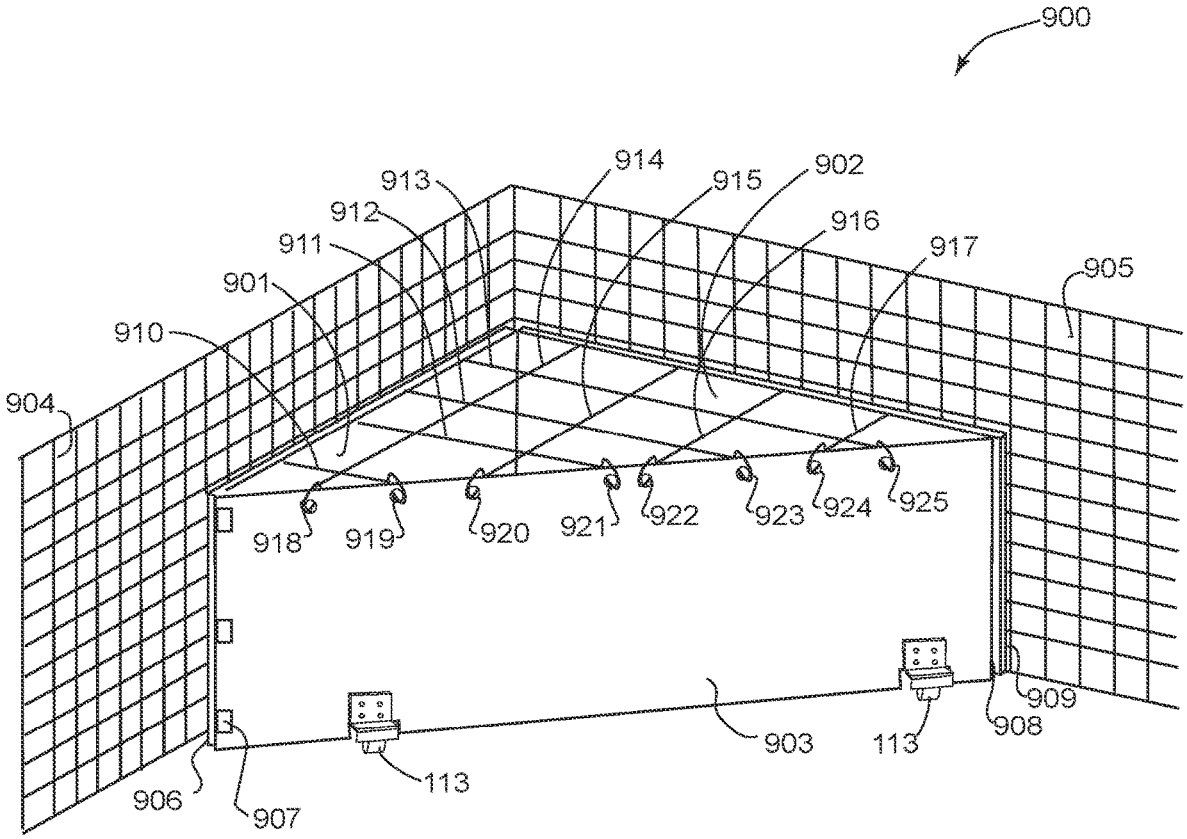
FIG. 9. Perspective view of a three-sided protective enclosure comprising a deployable protective ceiling in a fully deployed configuration, according to some embodiments of the disclosure.

Partitions 501-504 may comprise materials substantially as described above for earlier-described embodiments. For example, partitions 501-504 may comprise 0.25 inch to 0.5 inch thick AR500 steel plate. In some embodiments, articulated partitions 501 and 502 may comprise casters 113 attached to bottom horizontal edges 510 and 511, respectively. In some embodiments, casters 113 may be substantially as described above. It may also be understood that although not shown, a latching means may be present to secure articulated partitions 503 and 504 into a closed position. In some embodiments, protective enclosure 500 may comprise a single articulated partition, as shown in FIG. 9.

Figure 5B:
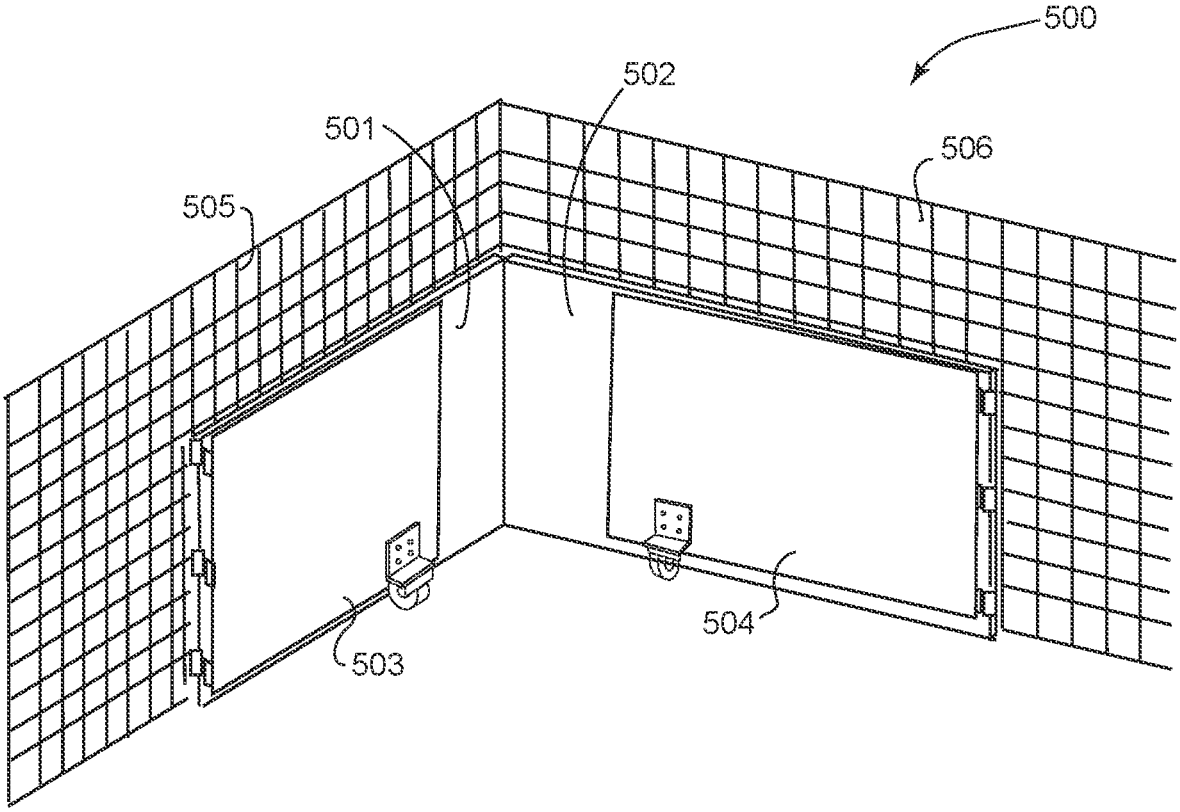
FIG. 5*b*. Perspective view of the protective enclosure shown in FIG. 5*a* in a stowed configuration, according to some embodiments of the disclosure.

FIG. 5*b* shows protective enclosure 500 in an exemplary stowed position. In the illustrated embodiment, articulated partitions 503 and 504 are folded against fixed partitions 501 and 502. Alternatively, articulated partitions 503 and 504 may be stowed against walls 505 and 506, respectively.

FIG. 6*a* shows an alternative three-sided protective enclosure 600 in a mid-wall configuration, having a single fixed partition 601 and two articulated partitions 602 and 603. Fixed partition 601 may be affixed to single wall 604 within an interior of a room, or in an outdoor deployment. Articulated partitions 602 and 603 may articulate via hinges 605 from vertical edges 606 and 607 of fixed partition 601, respectively, and close at far vertical edges 608 and 609 of articulated partitions 602 and 603, respectively. One or more casters 113 may be along bottom horizontal edges 610 and 611 of each of articulated partitions 602 and 603 to facilitate deployment of articulated partitions 602 and 603 to a closed three-sided (e.g., triangular) structure surrounding interior space 612.

FIG. 6*b* illustrates protective enclosure 600 in an exemplary stowed configuration. Both articulated partitions 602 and 603 are opened flat against wall 604, fully exposing fixed partition 601. In alternative embodiments, at least one of articulated partitions 602 and 603 may be folded against fixed partition 601. The dashed arrows show that articulated partitions 602 and 603 may be swung into the closed triangular configuration shown in FIG. 6*a*.

Figure 7:
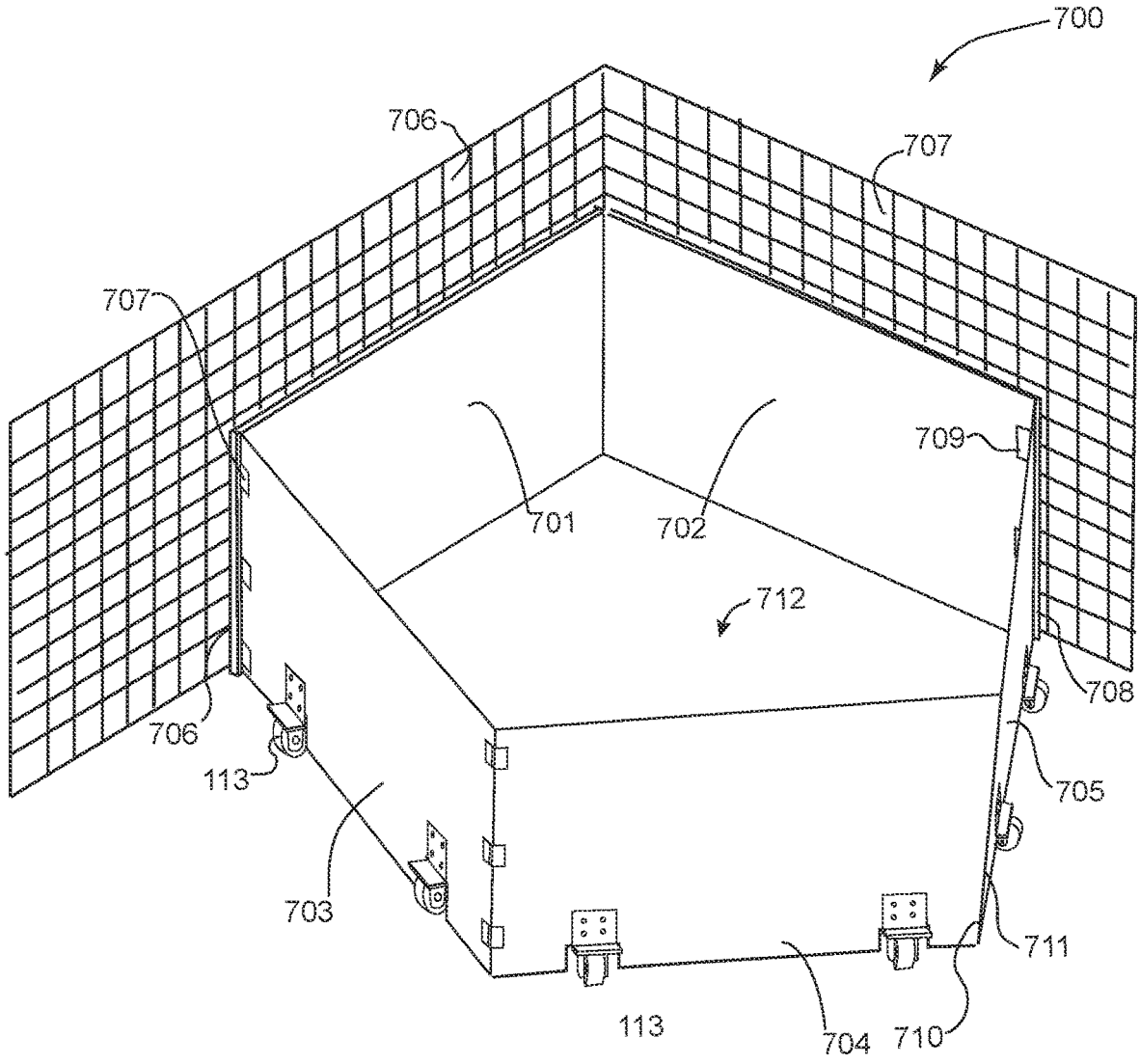
FIG. 7. Perspective view of a five-sided protective enclosure affixed to two interior or exterior walls at a corner, according to some embodiments of the disclosure.

FIG. 7 illustrates protective enclosure 700, having five sides forming a pentagonal structure as shown, comprising fixed partitions 701 and 702, coupled to articulated partitions 703, 704 and 705. In the illustrated embodiment, articulated partition 703 articulates from vertical edge 706 of fixed partition 701 by virtue of hinges 707, whereas articulated partition 705 articulates from vertical edge 708 of fixed partition 702 by virtue of hinges 709. Vertical edges 710 and 711 of articulated partitions 704 and 705, respectively, may be brought into adjacency for closure of protective enclosure 700, surrounding interior space 712 on five sides. In alternate embodiments, articulated partition 705 may articulate from vertical edge 710 of articulated partition 704.

Figure 8A:
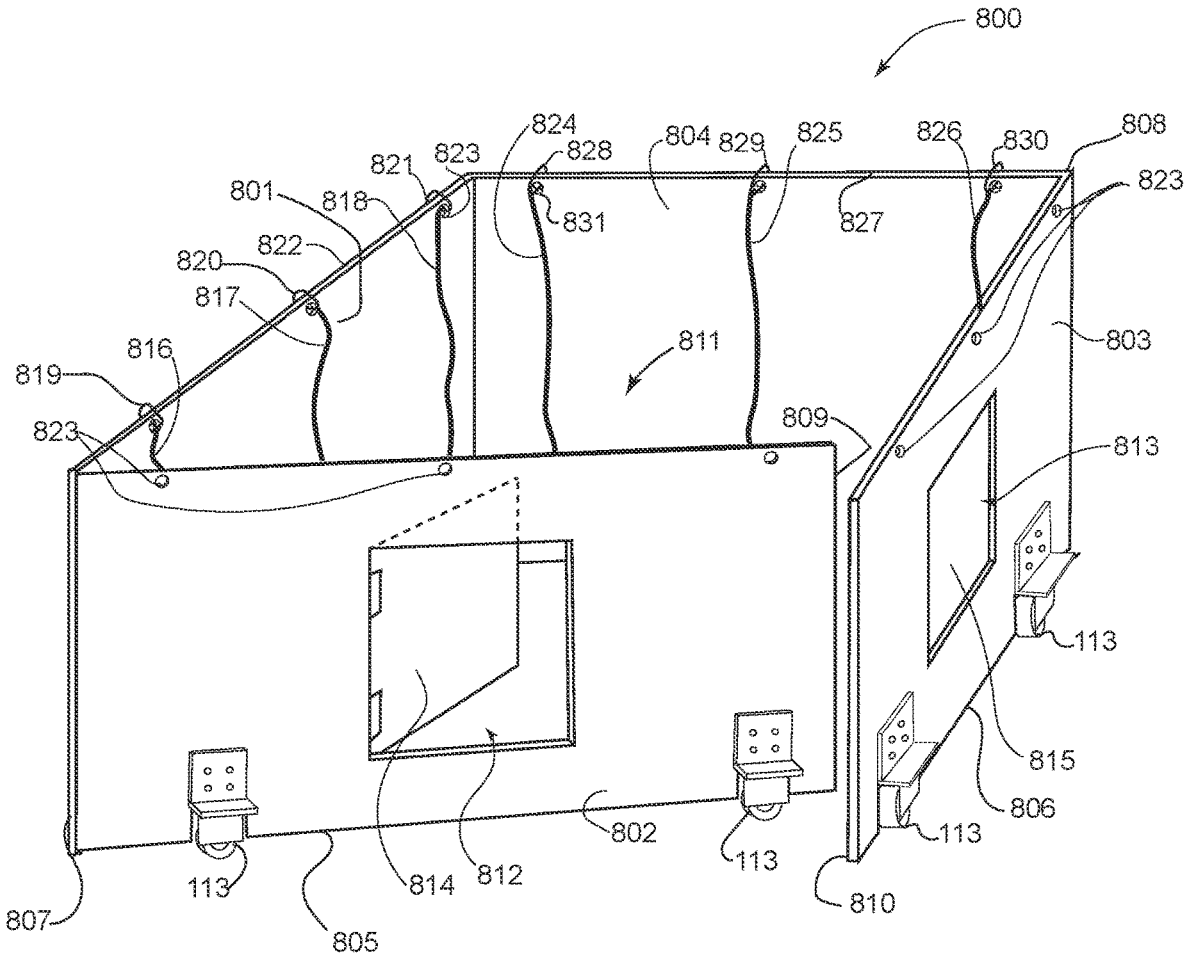
FIG. 8*a*. Perspective view of a four-sided protective enclosure comprising a deployable protective ceiling, the four-sided protective enclosure in a semi-deployed configuration, according to some embodiments of the disclosure.

FIG. 8*a* illustrates protective enclosure 800, having a deployable protective ceiling comprising a grid of high-strength cables to protect occupants from falling objects and debris. In the illustrated embodiment, protective enclosure 800 is a four-sided structure comprising partitions 801, 802, 803 and 804. In some embodiments, protective enclosure

800 is a three-sided or five-sided structure, similar to protective enclosures 600 or 700, respectively, for example. In some embodiments, partitions 801 and/or 804 may be fixed partitions. For example, partitions 801 and 804 may be affixed to one wall or two intersecting walls. In some embodiments, partition 801 and 804 are free standing and articulated structures, similar to partitions 201 and 202 shown in FIG. 2.

Partitions 801-804 may comprise materials having sufficient strength to deflect flying and ballistic objects, such as bullets or high velocity flying debris launched by an explosion or hurled into the air by a tornado or hurricane. In some embodiments, partitions 801-804 comprise materials compliant with NIJ Level II through Level IV specifications described above. An example is AR500 steel plate having a minimum thickness of 0.25 inch, for example, compliant with a NIJ Level III rating. However, other materials that have been listed above and other suitable materials not listed may be employed. Partitions 801-804 may have suitable dimensions that afford maximal protection to occupants from laterally flying or ballistic projectiles. For example, any or all of partitions 801-804 may have dimensions of 4 feet tall by 8 feet wide, affording protection for up to 10 adult occupants, and a thickness ranging from 0.25 inch to 0.5 inch.

Casters 113, described in detail above, are shown attached near the bottom horizontal edges 805 and 806 of partitions 802 and 803, respectively, may facilitate manipulation of partitions 801-804, for example to swing articulated partitions (e.g., partitions 802 and 803) into a deployed (e.g., closed) state. As noted above, casters 113 may have a fixed orientation or swivel to follow a desired arc of articulated partitions (e.g., partitions 802 and 803) when handled.

Partitions 802 and 803 may be articulated partitions. In some embodiments, partition 802 articulates with partition 801 at vertical edge 807, whereas partition 803 articulates from vertical edge 808 of partition 804, as shown. In some embodiments, vertical edge 809 of partition 803 articulates from vertical edge 810 of partition 802 (not shown).

Protective enclosure 800 may be closed by swinging one or both of partitions 802 and 803 to bring vertical edges 809 and 810 into adjacency and securing partitions 802 and 803 in place by a securing means (not shown) as described above. Interior space 811 may be enclosed on four sides, configured as a square, rectangle, rhombus or other parallelogram, depending on the relative lengths of partitions 801-804, which may have any suitable dimensions.

In the illustrated embodiment, articulated partitions 802 and 803 optionally comprise hatches 812 and 813, respectively. In the illustrated example, hatches 812 and 813 are approximately within the center portions of partitions 802 and 803. In alternate embodiments, hatches 812 and 813 may be at any suitable location within partitions 802 and 803, including to the right side or left side of any of partitions 801-804. While the illustrated embodiment only shows partitions 802 and 803 comprising hatches, it will be understood that partitions 801 and 804 may also comprise similar hatches. Hatches 812 and 813 may be employed as emergency entrances and/or exits once partitions 802 and 803 are deployed. Hatches 812 and 813 may be accompanied by hatch doors 814 and 815, respectively, for closing hatches 812 and 813.

As noted, hatches 812 and 813 may be employed for entrance and exit by occupants during an emergency. For example, partitions 802 and 803 may first be deployed from a stowed state (not shown), and hatches 812 and 813 opened to allow children in a classroom and/or adults in a classroom, office or other space where a group may be gathered to enter protective enclosure 800. Hatch doors 814 and 815 may be shut against hatches 812 and/or 813 for fully enclosing any occupants within protective enclosure 800.

Protective enclosure 800 may optionally comprise a deployable protective ceiling comprising high-strength steel cables arranged as a cargo netting, for example. In the illustrated embodiment, cables 816, 817 and 818 are shown to have one end secured to partition 801. While three cables are shown to be attached to partition 801 in the illustrated embodiment, any suitable number of cables may be employed. In the illustrated embodiment, hooks 819, 820 and 821 may be employed as receiving structures to secure cables 816-818 to upper horizontal edge 822 of partition 801 through holes 823. Likewise, cables 824, 825 and 826 may be secured at one end to top horizontal edge 827 of partition 804 by receiving structures. As an example, hooks 828, 829 and 830, secured to partition 804 by threading through holes 831, may be respectively employed to hang cables 824-826 from top horizontal edge 827. While hooks are included in the illustrated embodiment, it is understood that any suitable means of attachment of cables to any partition may be employed. While three cables are shown attached to partition 804 in the illustrated embodiment, it is understood that any suitable number of cables may be employed.

Cables 816-818 and 824-826 may have a suitable strength to deflect heavy falling objects, for example weighing 3000 pounds or more. In some embodiments, cables 816-818 and 824-826 comprise high-strength steel, for example, capable of break strengths of 5000 to 10,000 pounds. In some embodiments, other non-elastic rope materials may be employed, for example non-metal materials comprising, for example, Dyneema or Kevlar, may be employed, capable of similar properties and strength held by some steel alloys suitable for cable. For example, cables 816-818 and 824-826 may be rated to a break strength of 3000 to 10,000 pounds. While in the illustrated embodiment, cables 816-818 and 824-826 shown hanging downwardly in an un-deployed state, other storage configurations may be employed when cables 816-818 and 824-826 are not in use.

Figure 8B:
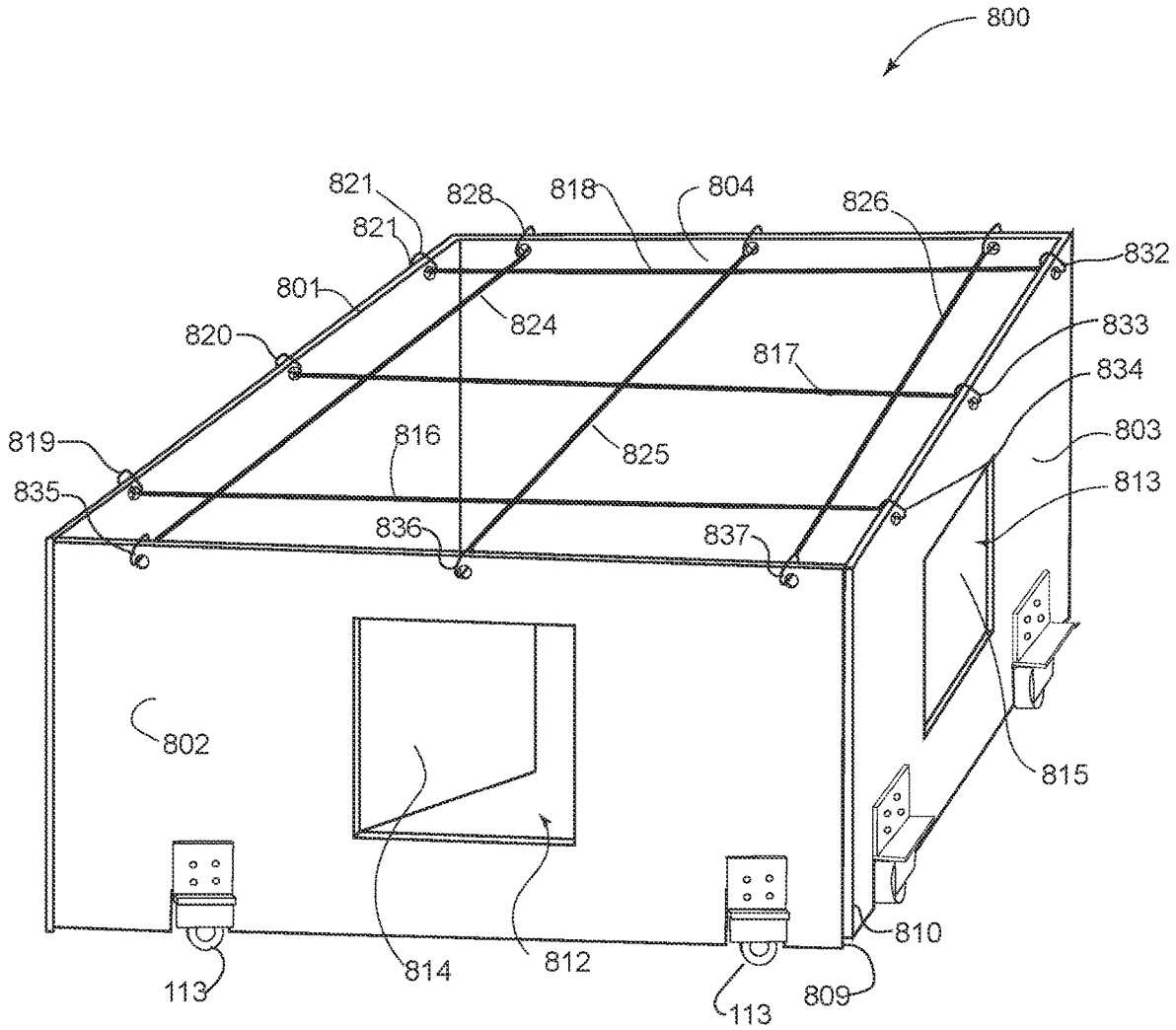
FIG. 8*b*. Perspective view of the four-sided protective enclosure shown in FIG. 8*a* comprising the deployable protective ceiling in a fully deployed configuration, according to some embodiments of the disclosure.

FIG. 8*b* shows cables 816-818 and 824-826 in a deployed state, whereby cables 816-818 and 824-826 are extended between partitions 801 and 803, and 802 and 804, respectively. In a deployed state, cables 816-818 and 824-826 are stretched over the top of protective enclosure 800 in a grid formation, as shown. As shown in the illustrated embodiment, articulated partitions 802 and 803 are fully deployed, whereby vertical edge 809 of partition 802 and vertical edge 810 of partition 803 are adjacent. A latching means as described above (not shown) may be employed to secure and/or immobilize partitions 802 and 803. Cables 816-818 and 824-826 are attached to opposing partitions (e.g., stretching cables 816-818 between partition 801 and partition 803). Cables 816-818 are extended between partitions 801 and 803 and may be similarly secured at their opposite ends to partition 803 by receiving structures such as hooks 832, 833 and 834, respectively. Cables 824-826 are similarly deployed, secured to partition 802 at opposing ends by hooks substantially orthogonal to cables 816-818. As a result, a protective ceiling may be provided by deploying cables 816-818 and 824-826 in an orthogonal or non-orthogonal grid or mesh pattern. Cables 816-818 and 824-826 may be deployed to deflect large falling or flying debris from striking occupants, for example in a tornado, hurricane or earthquake.

Figure 8C:
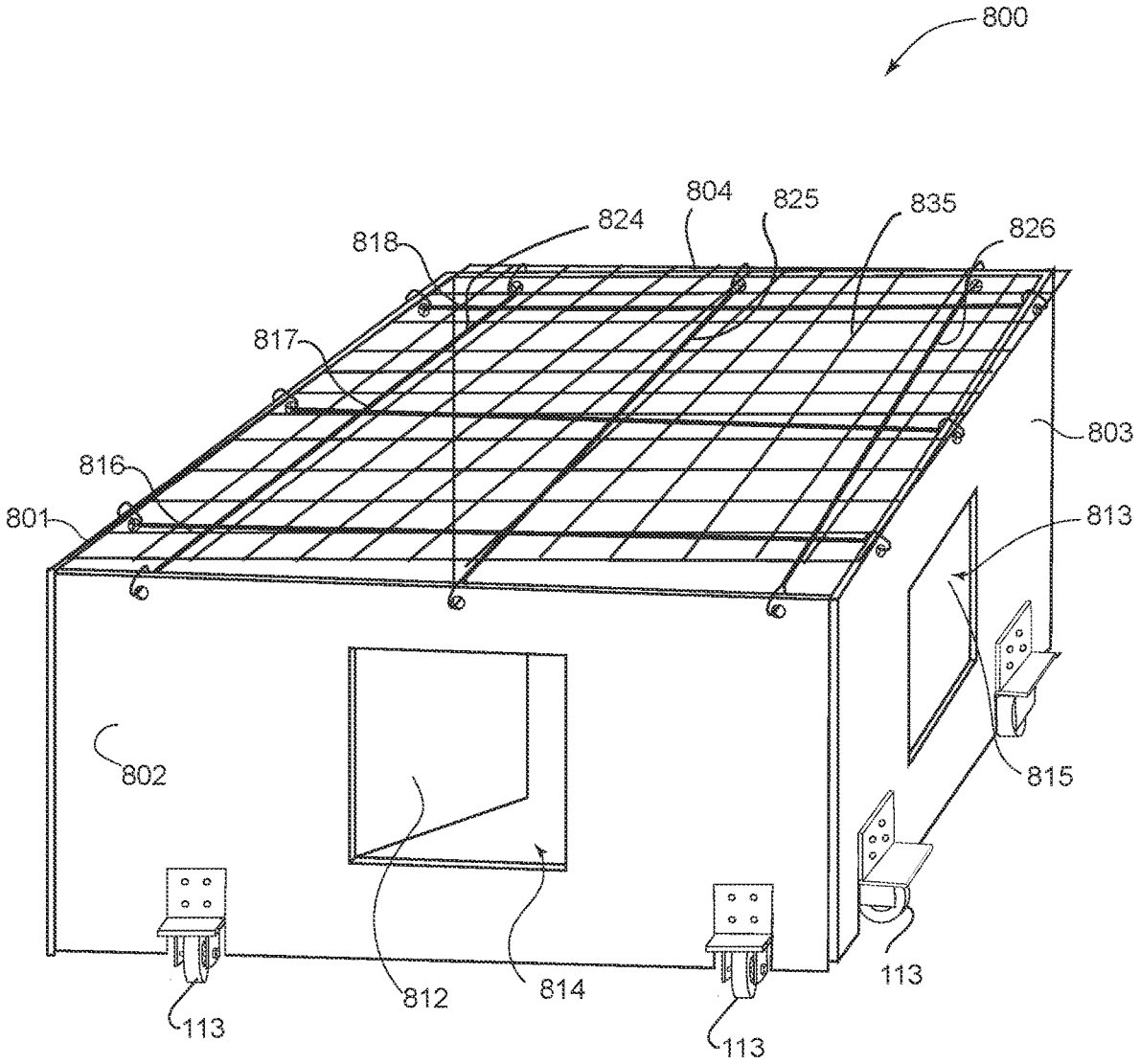
FIG. 8*c*. Perspective view of the four-sided protective enclosure shown in FIG. 8*b* further comprising a secondary netting, according to some embodiments of the disclosure.

In FIG. 8*c*, protective enclosure 800 may optionally comprise secondary netting 835, shown in a deployed state, extended over the top of protective enclosure 800 as part of a deployable protective ceiling extending in one direction between partitions 801 and 803, and in an orthogonal direction between partitions 802 and 804. Netting 835 may have a smaller mesh than that provided by cables 816-818 and 824-826, providing an enhanced protective mesh against falling objects that are smaller than the mesh size provided by cables 816-818 and 824-826. Netting 835 may supplement cables 816-818 and 824-826 to deflect falling debris that may be smaller than the spacing between cables 816-818 and 824-826. In some embodiments, netting 835 may comprises steel cable substantially similar to steel cable described for cables 816-818 and 824-826. In alternate embodiments, netting 835 comprises non-metallic materials, such as, but not limited to, Dyneema or Kevlar, as described above. Netting 835 may be unfurled over extended cables 816-818 and 824-826 and secured to partitions 801-804 by separate hooks or other suitable means (not shown). Effective protection against a variety of threats to occupants of classrooms offices and other interior spaces may be extended by netting 835.

In FIG. 9, protective enclosure 900 is a three-sided enclosure that is substantially similar to protective enclosure 400 illustrated in FIGS. 4*a* and 4*b*. Protective enclosure 900 comprises a deployable protective ceiling similar to that described for four-sided protective enclosure 800. Protective enclosure 900 comprises partitions 901, 902 and 903. Partitions 901 and 902 are fixed partitions and may be affixed to intersecting walls 904 and 905 as shown. Partition 903 is an articulated partition that may articulate from vertical edge 906 of fixed partition 901 by virtue of hinges 907. Casters 113, described above, may support articulated partition 903 and facilitate its handling and deployment or stowage. As illustrated in FIG. 9, protective enclosure 900 is in a fully deployed state, whereby vertical edge 908 of articulated partition 903 is adjacent to vertical edge 909 of fixed partition 902. As noted above, a latching or other means (not shown) may be present to secure articulated partition 903. Partitions 901-903 may comprise suitable dimensions and materials as have been described above.

Protective enclosure 900 further comprises cables 910, 911, 912 and 913 extending from fixed partition 901 to articulated partition 903. Likewise, cables 914, 915, 916 and 917 extend from fixed partition 902 to articulated partition 903. As shown in the illustrated embodiment, cables 910-913 may extend substantially orthogonally with respect to cables 914-917, forming a grid mesh that may afford a protective measure for occupants of protective enclosure 900 against falling objects and debris. Cables 910-917 may be attached at one end to fixed partitions 901 and 902 by similar means (e.g., hooks 832-837 in FIG. 8*b*) as employed for protective enclosure 800. As shown in the illustrated embodiment of FIG. 9, cables 910-917 are attached at their opposing ends to articulated partition 903 by hooks 918, 919, 920, 921, 922, 923, 924 and 925. It is understood that other suitable means to secure cables 910-917 to partitions 901-903 may be employed.

It will be understood by persons skilled in the art that the foregoing embodiments serve as manifestations of the innovation described in this disclosure, and by no means are to be construed as limiting the scope of the innovation. Variations of the disclosed embodiments may be construed as equivalent, and do not depart from the spirit and the scope of the innovation herein described and disclosed.

We claim:

1. A protective enclosure, comprising:

a first partition having a first vertical edge and an opposing second vertical edge;

a second partition adjacent to the first partition, the second partition having a third vertical edge and an opposing fourth vertical edge, wherein the third vertical edge is adjacent to the second vertical edge;

a third partition having a fifth vertical edge and an opposing sixth vertical edge, wherein the fifth vertical edge is adjacent to the first vertical edge, and wherein the fifth vertical edge has an articulated joint with the first vertical edge;

a plurality of cables, wherein ones of the plurality of cables have a first end secured to the first partition, wherein the ones of the plurality of cables are extendable from the first partition to the second partition or to the third partition, and wherein the ones of the plurality of cables have a second end that is securable to the second or to the third partition; and a netting extending over the plurality of cables, the netting is securable to the first, second and third partitions and has a mesh size that is less than a distance between adjacent ones of the plurality of cables, wherein:

any of the first partition, the second partition and the third partition comprise a ballistic material; and the first, second and third partitions are to be configured to form at least a part of a perimeter of a closed polygon having at least three sides surrounding an interior space.

2. The protective enclosure of claim 1, further comprising a fourth partition between the second partition and the third partition, the fourth partition having a seventh vertical edge and an opposing eighth vertical edge, wherein:

the seventh vertical edge articulates with the sixth vertical edge of the third partition; or the eighth vertical edge articulates with the fourth vertical edge of the second partition.

3. The protective enclosure of claim 2, wherein the first, second, third and fourth partitions are to be configured to form a closed polygon surrounding the interior space when the seventh vertical edge of the fourth partition is adjacent to the sixth vertical edge of the third partition and the eighth vertical edge of the fourth partition is adjacent to the fourth vertical edge of the second partition.

4. The protective enclosure of claim 2, further comprising a fifth partition between the second partition and the fourth partition, the fifth partition having a ninth vertical edge and an opposing tenth vertical edge, wherein:

the ninth vertical edge articulates with the eighth vertical edge; or the tenth vertical edge articulates with the fourth vertical edge; and the first, second, third, fourth and fifth partitions are to be configured to form the perimeter of a closed polygon surrounding the interior space when the ninth vertical edge of the fifth partition is adjacent to the eighth vertical edge of the fourth partition and the tenth vertical edge of the fifth partition is adjacent to the fourth vertical edge of the second partition.

5. The protective enclosure of claim 2, wherein the plurality of cables comprises six or more cables, at least three of the six or more cables each having a first end secured to a first receiving structure on the first partition and a second end securable to a second receiving structure on the third partition, and at least three of the six or more cables each having a first end affixed to a third receiving structure on the second partition and a second end securable to a fourth receiving structure on the fourth partition.

6. The protective enclosure of claim 5, wherein the six or more cables have a tensile strength of at least 3000 pounds.

7. The protective enclosure of claim 1, wherein the ballistic material is any one of AR 500 alloy steel, fiberglass composite, silicon carbide, polyethylene or a composite comprising a ceramic powder in a polyethylene matrix.

8. The protective enclosure of claim 2, wherein at least a first caster is affixed to a first bottom edge of the third partition, and wherein at least a second caster is affixed to a second bottom edge of the fourth partition.

9. The protective enclosure of claim 1, wherein at least one of the first partition, second partition and the third partition comprises a hatch.

10. The protective enclosure of claim 1, further comprising a fourth partition between the second partition and the third partition, wherein the fourth partition has a seventh vertical edge and an opposing eighth vertical edge, wherein:

the fifth vertical edge of the third partition articulates with the first vertical edge of the first partition;

the eighth vertical edge of the fourth partition articulates with the fourth vertical edge of the second partition;

the third partition and the fourth partition each have a length that is substantially one half of the distance between the first vertical edge of the first partition and the fourth vertical edge of the second partition; and the first, second, third and fourth partitions are to be configured to form a closed polygon surrounding the interior space when the seventh vertical edge of the fourth partition is adjacent to the sixth vertical edge of the third partition.

11. A system, comprising:

an area having a perimeter comprising a first wall and a second wall; and a protective enclosure within the area, the protective enclosure comprising:

a first partition having a first vertical edge and an opposing second vertical edge;

a second partition adjacent to the first partition, the second partition having a third vertical edge and an opposing fourth vertical edge, wherein the third vertical edge is joined to the second vertical edge;

a third partition having a fifth vertical edge and an opposing sixth vertical edge, wherein the fifth vertical edge is adjacent to the first vertical edge and wherein the fifth vertical edge has an articulated joint with the first vertical edge;

a plurality of cables, wherein ones of the plurality of cables have a first end secured to the first partition, wherein the ones of the plurality of cables are extendable from the first partition to the second partition or to the third partition, and wherein the ones of the plurality of cables have a second end that is securable to the second or to the third partition; and a netting extending over the plurality of cables, the netting is securable to the first, second and third partitions and has a mesh size that is less than a distance between adjacent ones of the plurality of cables, wherein:

any of the first partition, the second partition and the third partition comprise a ballistic material;

the first, second and third partitions are to be configured to form at least a part of a perimeter of a closed polygon having at least three sides surrounding an interior space.

12. The system of claim 11, wherein the area is a room having a perimeter comprising the first wall and the second wall, wherein the first wall and the second wall are interior walls, or wherein the area is an outdoor space having a perimeter comprising the first wall and the second wall, wherein the first wall and the second wall are exterior walls.

13. The system of claim 11, wherein the first wall has a joint with the second wall, wherein the first partition is affixed to the first wall and the second partition is affixed to the second wall, wherein the second edge of the first partition is adjacent to the third edge of the second partition, and wherein the joint between the first wall and the second wall is between the second edge of the first partition and the third edge of the second partition.

14. The system of claim 11, wherein the first partition is affixed to the first wall or to the second wall, wherein:

the second partition has an articulated joint with the first partition wherein the third vertical edge articulates with the second vertical edge;

the third partition has an articulated joint with the first partition wherein the fifth vertical edge articulates with the first vertical edge; or the third partition has an articulated joint with the second partition wherein the sixth vertical edge articulates with the fourth vertical edge; and the first partition, second partition and the third partition are to be configured to form a closed polygon surrounding the interior space when the sixth edge of the third partition is adjacent to the second edge of the first partition, or the fifth edge of the third partition is adjacent to the fourth edge of the second partition.

15. The system of claim 11, wherein the protective enclosure is a stand-alone structure, wherein the protective enclosure is detached from the first wall and from the second wall.

16. The system of claim 11, further comprising a fourth partition between the second and third partitions, wherein the first partition is affixed to the first wall and the second partition is affixed to the second wall, wherein the first wall has a joint with the second wall, wherein:

the fourth partition comprises a seventh vertical edge and an opposing eighth vertical edge;

the third partition has an articulated joint with the first partition wherein the fifth vertical edge articulates with the first vertical edge;

the fourth partition has an articulated joint with the second partition wherein the eighth vertical edge articulates with the fourth vertical edge; or the fourth partition has an articulated joint with the third partition wherein the seventh vertical edge articulates with the sixth vertical edge; and the first, second, third and fourth partitions are to be configured to form a closed polygon surrounding the interior space when the seventh vertical edge of the fourth partition is adjacent to the sixth vertical edge of the third partition or the eighth vertical edge of the fourth partition is adjacent to the fourth vertical edge of the second partition.

17. The system of claim 11, further comprising a fourth partition between the second and third partitions, the fourth partition having a seventh vertical edge and an opposing eighth vertical edge, wherein:

the first partition is affixed to the first wall or to the second wall;

the second partition has an articulated joint with the first partition wherein the third vertical edge articulates with the second vertical edge;

the third partition has an articulated joint with the first partition wherein the fifth vertical edge articulates with the first vertical edge; and the fourth partition has an articulated joint with the second partition wherein the eighth vertical edge articulates with the fourth vertical edge; or the fourth partition has an articulated joint with the third partition wherein the seventh vertical edge articulates with sixth vertical edge; and the first, second, third and fourth partitions are to be configured to form a closed polygon surrounding the interior space when the seventh vertical edge of the fourth partition is adjacent to the sixth vertical edge of the third partition or the eighth vertical edge of the fourth partition is adjacent to the fourth vertical edge of the second partition.

18. The system of claim 11, wherein the plurality of cables comprises six or more cables, each cable having a first end affixed to a first horizontal edge at the top of the first partition and extendable to a first plurality of receiving structures proximal to a second horizontal edge at the top of the second partition and to a second plurality of receiving structures proximal to a third horizontal edge at the top of the third partition, and wherein each cable of the six or more cables has a second end that is attachable to the first plurality of receiving structures and to the second plurality of receiving structures.

19. The system of claim 11, further comprising a fourth partition between the second and third partitions, wherein:

the first partition is opposite the fourth partition and the second partition is opposite the third partition;

the plurality of cables comprises six or more cables;

at least three cables of the six or more cables having a first end affixed to the first partition and a second end extendable to a first plurality of receiving structures near the top of the third partition; and at least three cables of the six or more cables having a first end that is affixed to the second partition and a second end extendable to a second plurality of receiving structures near the top of the fourth partition.

20. The system of claim 11, further comprising a fourth partition between the second partition and the third partition, wherein the fourth partition has a seventh vertical edge and an opposing eighth vertical edge, wherein:

the first wall has a joint with the second wall;

the first partition is affixed to the first wall and the second partition is affixed to the second wall;

the fifth vertical edge of the third partition articulates with the first vertical edge of the first partition;

the eighth vertical edge of the fourth partition articulates with the fourth vertical edge of the second partition;

the third partition and the fourth partition each have a length that is substantially one half of the distance between the first vertical edge of the first partition and the fourth vertical edge of the second partition; and the first, second, third and fourth partitions are to be configured to form a closed polygon surrounding the interior space when the seventh vertical edge of the fourth partition is adjacent to the sixth vertical edge of the third partition.

* * * * *